US011414295B2

(12) United States Patent
Lai

(10) Patent No.: US 11,414,295 B2
(45) Date of Patent: Aug. 16, 2022

(54) CABLE ADJUSTER

(71) Applicant: Yen-Chi Lai, Chiayi (TW)

(72) Inventor: Yen-Chi Lai, Chiayi (TW)

( * ) Notice: Subject to any disclaimer, the term of this patent is extended or adjusted under 35 U.S.C. 154(b) by 132 days.

(21) Appl. No.: 16/897,383

(22) Filed: Jun. 10, 2020

(65) Prior Publication Data

US 2021/0387828 A1 Dec. 16, 2021

(51) Int. Cl.
*B65H 75/48* (2006.01)

(52) U.S. Cl.
CPC ..... *B65H 75/486* (2013.01)

(58) Field of Classification Search
CPC ... B65H 75/48; B65H 75/486; B65H 75/4418
See application file for complete search history.

(56) References Cited

U.S. PATENT DOCUMENTS 7,093,783 B2 * 8/2006 Warren ..... B65H 75/48 242/378.1
7,455,255 B1 * 11/2008 Chao ..... B65H 75/4431 242/378.1
8,870,111 B2 * 10/2014 Kwankijpongsa ..... B65H 75/4431 242/378
10,442,657 B1 * 10/2019 Hinnant ..... A62B 35/0093
2005/0145739 A1 * 7/2005 Warren ..... B65H 75/48 242/378.3
2009/0039191 A1 * 2/2009 Yen ..... B65H 75/4431 242/378.2

* cited by examiner

*Primary Examiner* — Sang K Kim
(74) *Attorney, Agent, or Firm* — Alan D. Kamrath; Karin L. Williams; Mayer & Williams PC

(57) ABSTRACT

A cable adjuster contains a gear shaft, a base, a rotatable disc, and a cable. The gear shaft includes a first column, a second column, a circular peg, and a threaded orifice. The base includes a first fixer and a second fixer. The first fixer has a first groove, and the second fixer has a second groove. An accommodation chamber is defined between the first groove and the second groove, the first fixer has a toothed notch and a circular notch, and the second fixer has a hollow shoulder, two T-shaped slots, and two holders. The rotatable disc includes a fixing orifice, a cylinder, and a recess. A head of the cable is received in the second fixer via the two T-shaped slots and is engaged in the recess so that an extension is fixed in one holder, and the rotatable disc is received in the second groove.

2 Claims, 8 Drawing Sheets

CABLE ADJUSTER

BACKGROUND OF THE INVENTION

Field of the Invention

The present invention relates to a cable adjuster which pulls or releases a cable by rotating a rotatable disc to reduce a length of the cable adjuster.

Description of the Prior Art

A conventional cable adjuster is applied to pull or release a cable adjustably so that a length of the cable extending out of an end of an extension is changeable, thus changing a curve portion of a chair back cushion or a magnetron resistance force of a flywheel exercise bike.

The conventional cable adjuster includes a screw rod and a screw not, and the screw rod is rotated to actuate the screw nut set and the cable to move, so a length of the cable is adjustable depending on a length of the screw rod, hence the cable adjuster is columnar and partially extends out of a chair back, thus causing poor appearance and very hard to be installed.

Another conventional rotatable cable adjuster is employed to decrease the length of the cable, but the cable is positioned by a resilient sheet and multiple recesses engaged with the resilient sheet, thus causing noises and a removal of the cable form the rotatable cable adjuster easily.

The present invention has arisen to mitigate and/or obviate the afore-described disadvantages.

SUMMARY OF THE INVENTION

The primary object of the present invention is to provide a cable adjuster which pulls a cable by rotating a rotatable disc, and a gear shaft is connected in the rotatable disc via a base, an adjustable knob is pressed to drive the gear shaft, and a spring is forced to move downward to a circular notch so that the gear shaft rotates to pull or release the cable; after releasing the adjustable knob, the spring pushes a gear to upwardly move back to an original position and to engage in a toothed notch, hence the cable is pulled by rotating the rotatable disc, and a length of the cable adjuster is reduced greatly.

Another object of the present invention is to provide a cable adjuster which when adjusting the cable, the gear shaft is pressed to drive the gear to remove from the toothed notch and to pull or release the cable, when releasing the adjustable knob, the spring pushes the gear shaft to move back to an original position and to engage in the toothed notch, thus avoiding noises and fixing the cable firmly by ways of the gear and the toothed notch.

To provide above-mentioned objects, a cable adjuster provided by the present invention contains a gear shaft, a base on which the gear shaft is connected, a rotatable disc driven by the gear shaft, and a cable pulled by rotating the rotatable disc. A first fixer has a toothed notch configured to correspond to a gear of the gear shaft, and the first fixer has a circular notch. A spring is fitted on a circular peg of an end of the gear shaft, and the gear shaft is received in the rotatable disc.

DETAILED DESCRIPTION OF THE PREFERRED EMBODIMENTS

Figure 1:
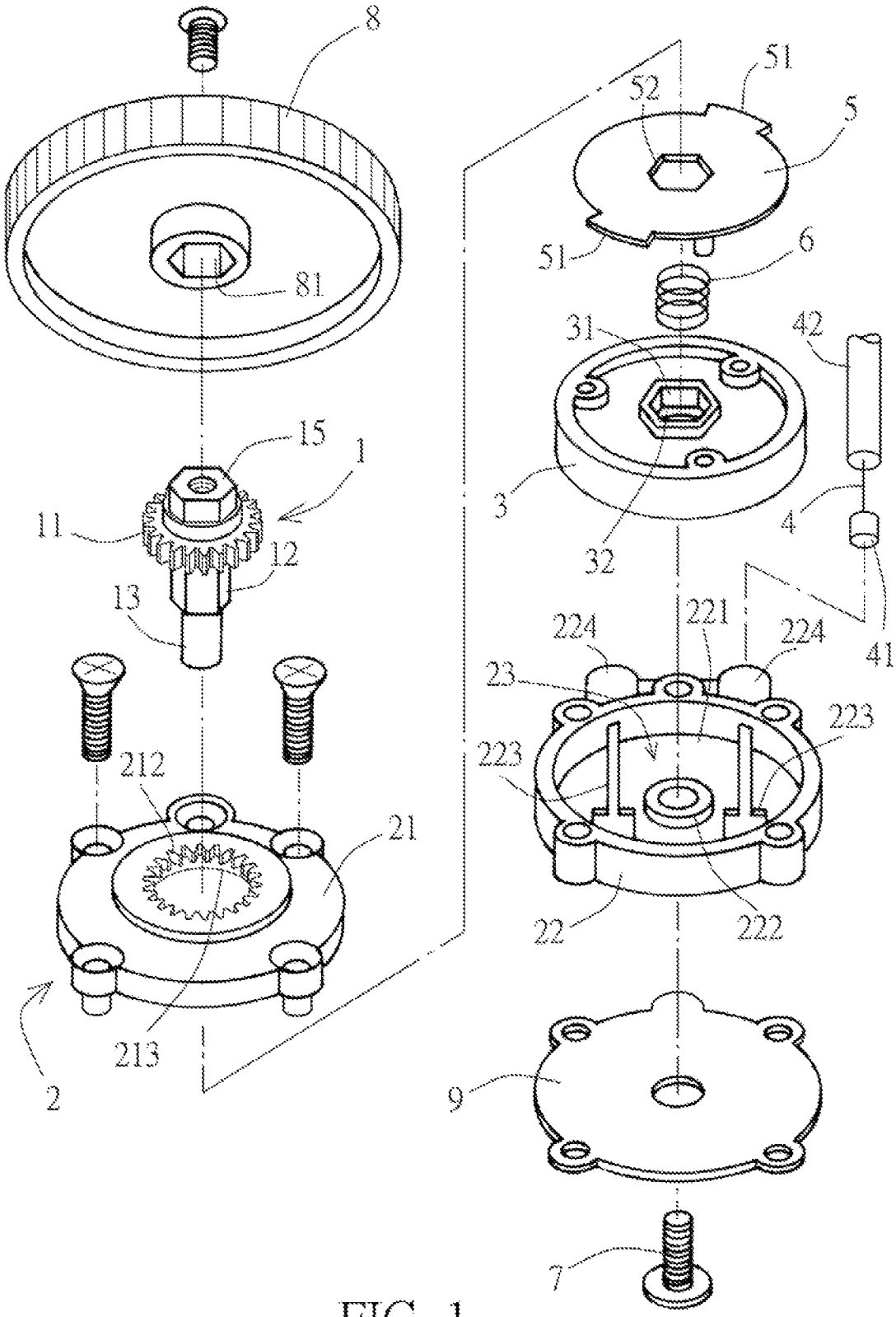
FIG. 1 is a perspective view showing the exploded components of a cable adjuster according to a preferred embodiment of the present invention.

The present invention will be clearer from the following description when viewed together with the accompanying drawings, which show, for purpose of illustrations only, a preferred embodiment in accordance with the present invention.

With reference to FIG. 1-4, a cable adjuster according to a preferred embodiment of the present invention comprises a gear shaft 1, a base 2 on which the gear shaft 1 is connected, a rotatable disc 3 driven by the gear shaft 1, and a cable 4 pulled by rotating the rotatable disc 3.

The gear shaft 1 includes a first column 15 extending from a first end thereof, a second column 12 extending from a second end of the gear shaft 1, a circular peg 13 extending from the second column 12, and a threaded orifice 14 defined in the circular peg 13.

Figure 2:
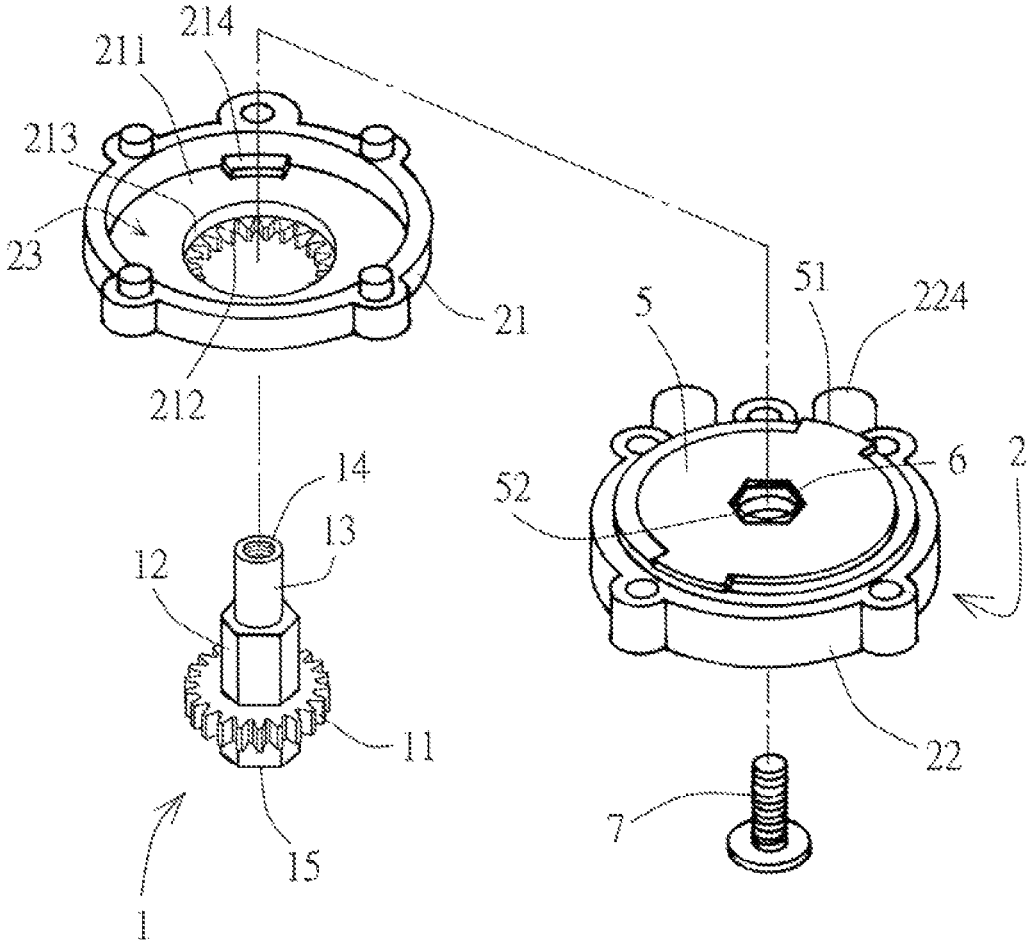
FIG. 2 is a perspective view showing the exploded components of a part of the cable adjuster according to the preferred embodiment of the present invention.

The base 2 includes a first fixer 21 and a second fixer 22, wherein the first fixer 21 has a first groove 211 defined thereon, and the second fixer 22 has a second groove 221 formed thereon and corresponding to the first groove 211, wherein when the first groove 211 of the first fixer 21 is connected with the second groove 221 of the second fixer 22, an accommodation chamber 23 is defined between the first groove 211 and the second groove 221 (as shown in FIG. 2) so as to accommodate the rotatable disc 3. The first fixer 21 has a toothed notch 212 and a circular notch 213 connected with the toothed notch 212. The second fixer 22 has a hollow shoulder 222 extending from a center of a bottom thereof, two T-shaped slots 223 defined on two sides of the bottom of the second fixer 22, and two holders 224 arranged on a peripheral side of the second fixer 22 (the two T-shaped slots 223 and the two holders 224 are selectively employed based on using requirements).

Figure 3:
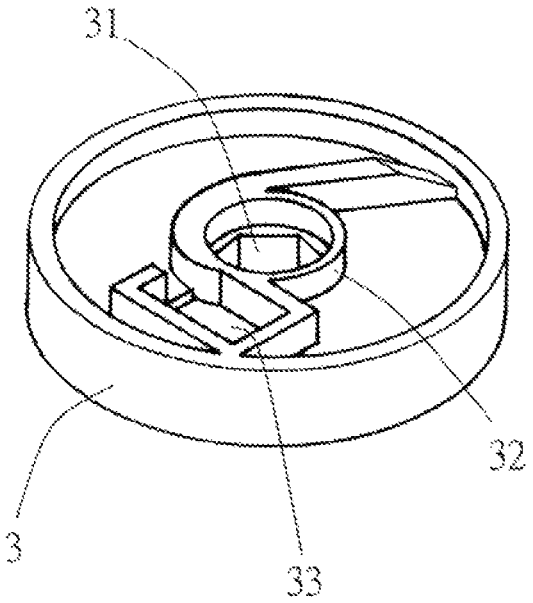
FIG. 3 is a perspective view showing a rotatable disc of the cable adjuster according to the preferred embodiment of the present invention.

The rotatable disc 3 includes a fixing orifice 31 defined on a center thereof, a cylinder 32 extending around the fixing orifice 31 (as shown in FIG. 3) and corresponding to the second groove 221, and a recess 33 defined outside a bottom of the cylinder 32.

Figure 4:
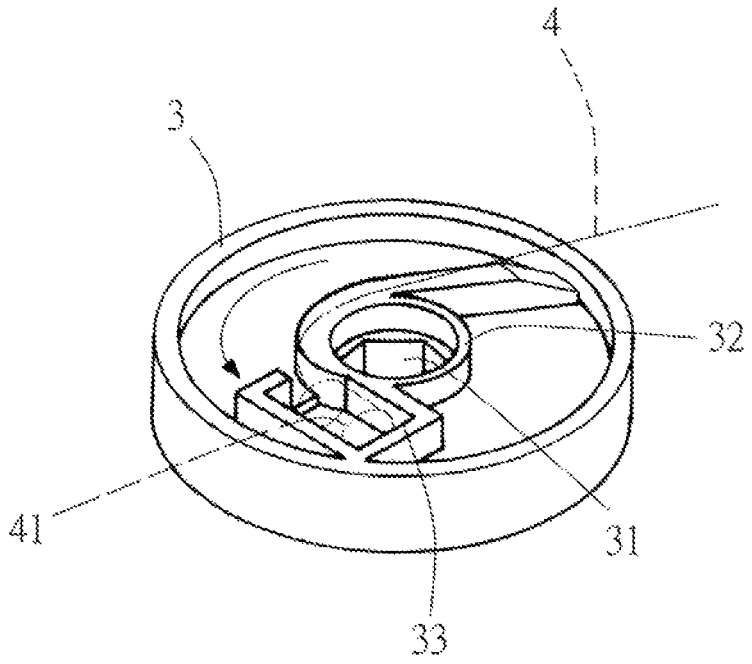
FIG. 4 is a perspective view showing the assembly of a cable and the rotatable disc of the cable adjuster according to the preferred embodiment of the present invention.
Figure 5:
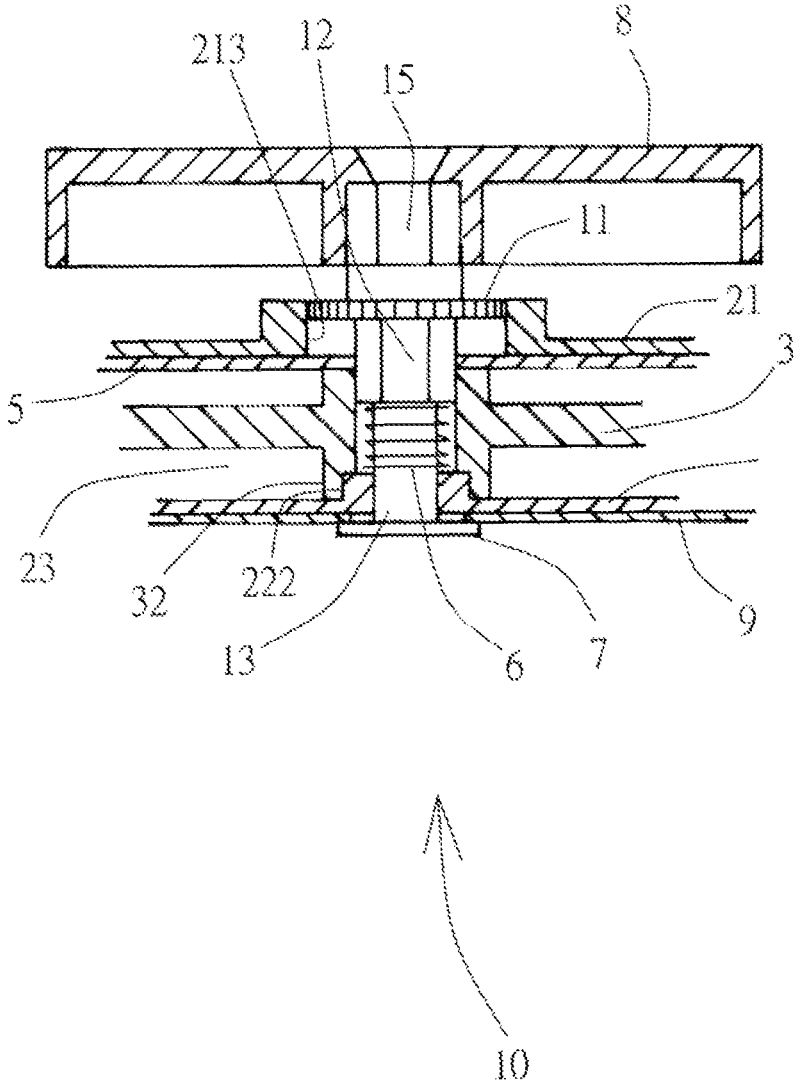
FIG. 5 is a cross-sectional view showing the assembly of the cable adjuster according to the preferred embodiment of the present invention.

Thereby, a head 41 of the cable 4 is received in the second fixer 22 via the two T-shaped slots 223 and is engaged in the recess 33 of the rotatable disc 3 (as illustrated in FIG. 4) so that an extension 42 is fixed in one of the two holders 224, and the rotatable disc 3 is received in the second groove 221, then the first fixer 21 and the second fixer 22 are connected (in this embodiment, the first fixer 21 and the second fixer 22 are connected in a screwing manner). A spring 6 is fitted on the circular peg 13 of the gear shaft 1, and the gear shaft 1 is inserted into the fixing orifice 31 of the rotatable disc 3 and the hollow shoulder 222 of the second fixer 22 so that a screw element 7 is screwed into the threaded orifice 14 of the circular peg 13 from the bottom of the second fixer 22 (as shown in FIG. 5, wherein a cap 9 is configured to cover the bottom of the second fixer 22 so as to protect the screw element), such that a gear 11 of the gear shaft 1 is engaged in the toothed notch 212, and the spring 6 abuts against the hollow shoulder 222 and the second column 12, then the first column 15 of the gear shaft 1 is connected with the a polygonal notch 81 of an adjustable knob 8 (by ways of another screw element), thus connecting the cable adjuster.

Figure 6:
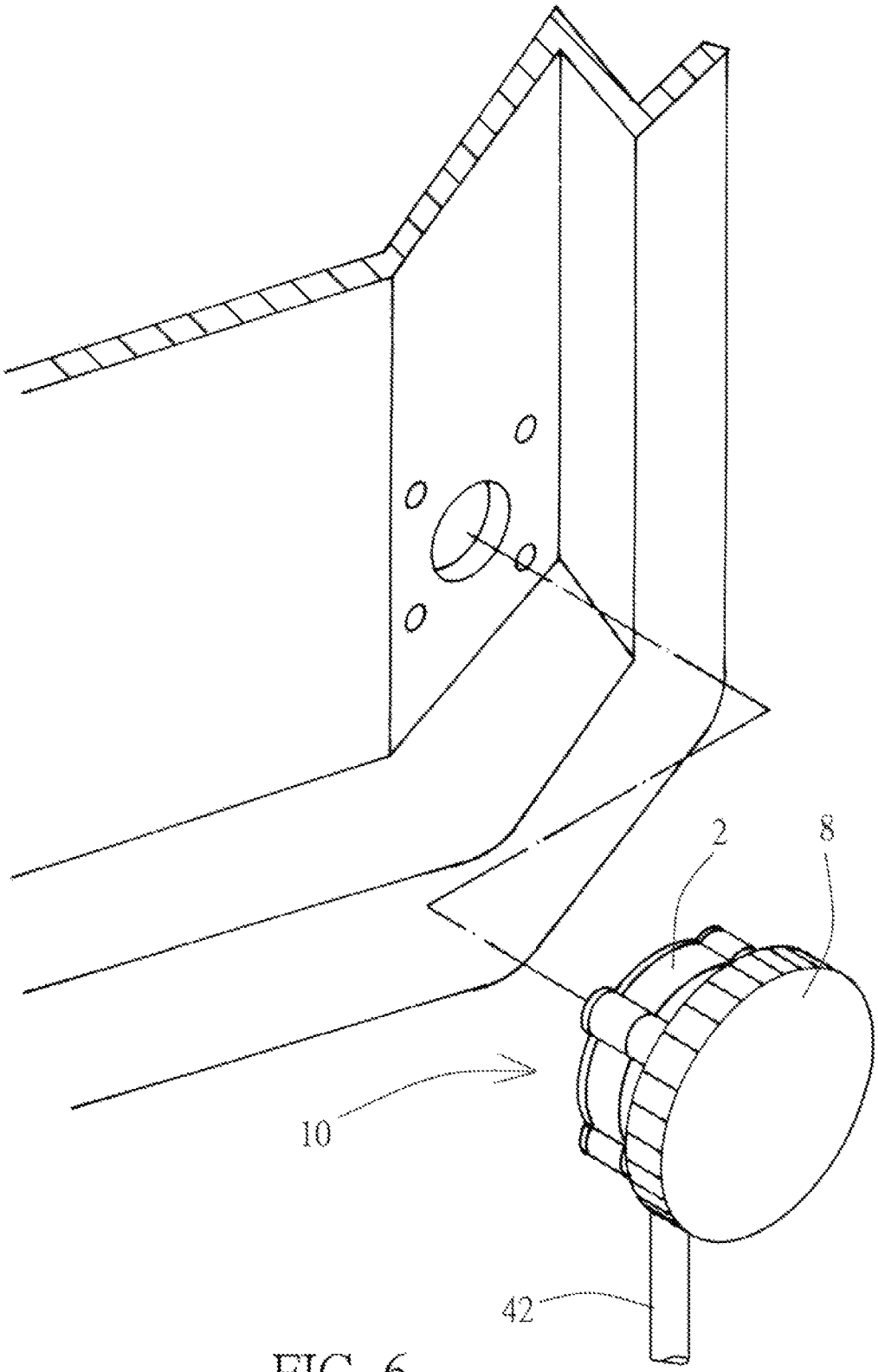
FIG. 6 is a cross-sectional perspective view showing the operation of the cable adjuster according to the preferred embodiment of the present invention.
Figure 7:
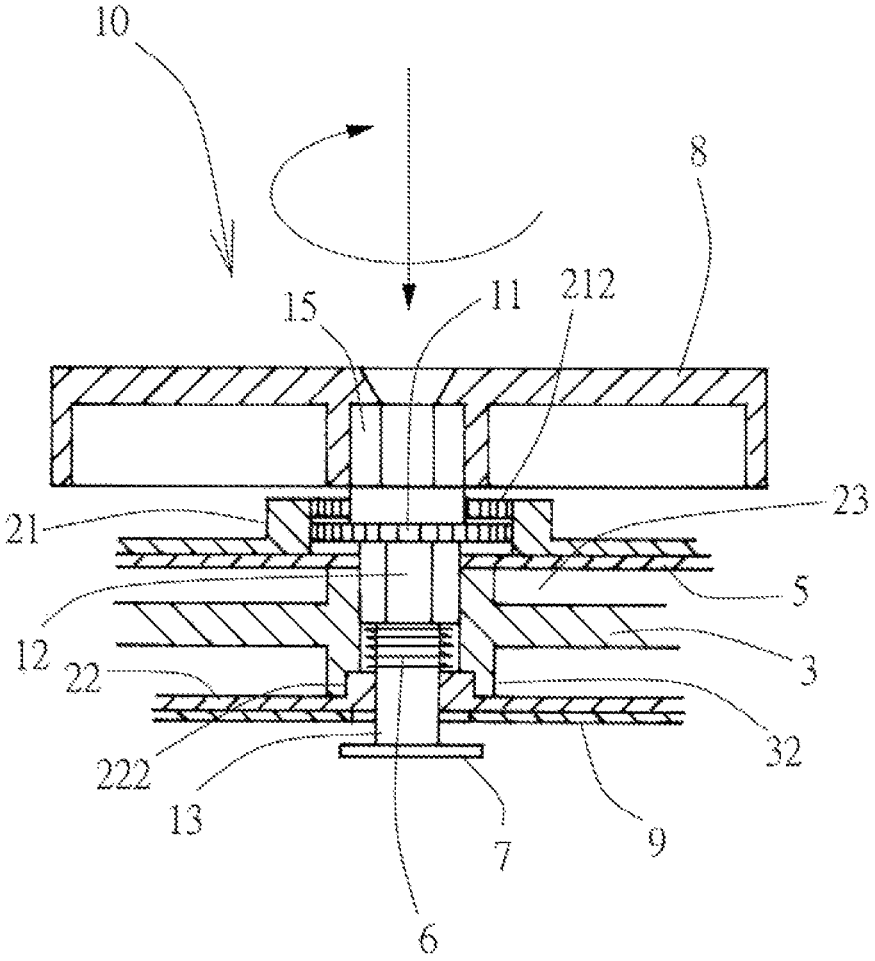
FIG. 7 is a cross-sectional view showing the operation of the cable adjuster according to the preferred embodiment of the present invention.

The cable 4 extending out of the extension 42 is mounted on a curve portion of a chair back cushion or a magnetron resistance force of a flywheel exercise bike (as shown in FIG. 6, the cable adjuster 10 is mounted on a side of a back of a chair back). When pulling or releasing the cable 4, the adjustable knob 8 is pressed to drive the gear shaft 1 to move with respect to the base 2 (as shown in FIG. 7), and the spring 6 is forced by the second column 12 and the hollow shoulder 222, in the meantime, the gear 11 moves downward to the circular notch 213 so as to remove from the toothed notch 212, such that the adjustable knob 8 is rotated to actuate the gear shaft 1 and the rotatable disc 3 to revolve on the base 2, and the cable 4 extending out of the recess 33 is winded around the cylinder 32 when the rotatable disc 3 rotates, thus pulling or releasing the cable 4. After releasing the adjustable knob 8, the spring 6 forces the gear 11 to upwardly move back to an original position and to engage in the toothed notch 212, hence the cable 4 is guided by rotating the rotatable disc 3, and the toothed notch 212 is engaged with the gear 11 firmly to avoid a removal of the cable 4. Preferably, a length of the cable adjuster 10 is decreased.

Figure 8:
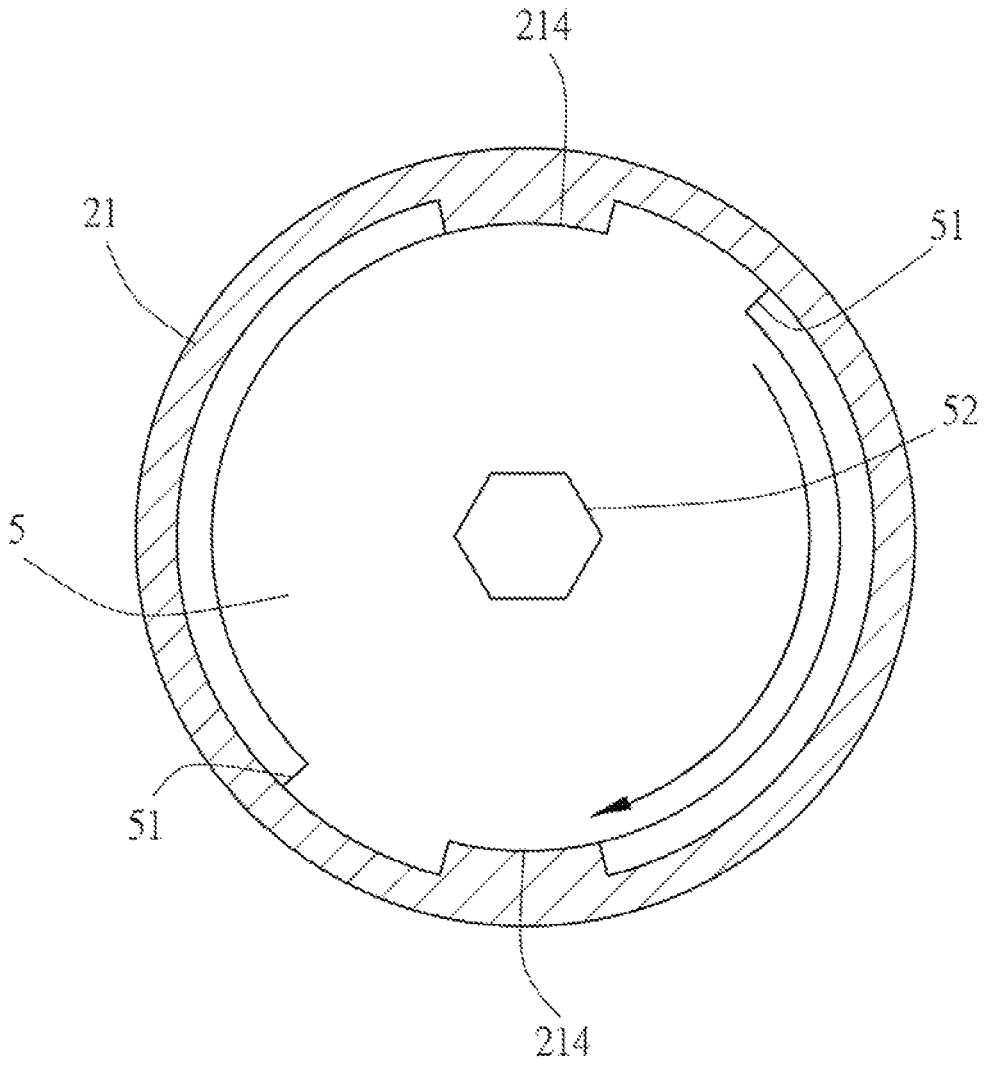
FIG. 8 is a cross-sectional view showing the operation of a defining plate of the cable adjuster according to the preferred embodiment of the present invention.

The first fixer 21 further has at least one limitation protrusion 214 extending from an inner wall of the first groove 211 thereof, and a defining plate 5 includes at least one sector-shaped locating tab 51 extending from a peripheral side thereof and configured to fit with a top of the rotatable disc 3 so that the second column 12 of the gear shaft 1 is inserted through a receiving orifice 52 of the defining plate 5 and the fixing orifice 31 of the rotatable disc 3 so as to be accommodated in the accommodation chamber 23 of the base 2. When the rotatable disc 3 is actuated by the gear shaft 1 to revolve, the defining plate 5 rotates to a rotating angle so that the at least one sector-shaped locating tab 51 contacts with the at least one limitation protrusion 214 (as shown in FIG. 8, when numbers of the at least one limitation protrusion 214 and the at least one sector-shaped locating tab 51 increase, the rotating angle of the rotatable disc 3 decreases), hence a pulling length of the cable 4 is limited by rotating the rotatable disc 3 to the rotating angle.

While various embodiments in accordance with the present invention have been shown and described, it is clear to those skilled in the art that further embodiments may be made without departing from the scope of the present invention.

What is claimed is:

1. A cable adjuster comprising a gear shaft, a base on which the gear shaft is connected, a rotatable disc driven by the gear shaft, and a cable pulled by rotating the rotatable disc;

wherein the gear shaft includes a first column extending from a first end thereof, a second column extending from a second end of the gear shaft, a circular peg extending from the second column, and a threaded orifice defined in the circular peg;

wherein the base including a first fixer and a second fixer, the first fixer has a first groove defined thereon, and the second fixer has a second groove formed thereon and corresponding to the first groove, and when the first groove of the first fixer is connected with the second groove of the second fixer, an accommodation chamber is defined between the first groove and the second groove to accommodate the rotatable disc, the first fixer has a toothed notch and a circular notch connected with the toothed notch, the second fixer has a hollow shoulder extending from a center of a bottom thereof, two T-shaped slots defined on two sides of the bottom of the second fixer, and two holders arranged on a peripheral side of the second fixer;

wherein the rotatable disc includes a fixing orifice defined on a center thereof, a cylinder extending around the fixing orifice and corresponding to the second groove, and a recess defined outside a bottom of the cylinder;

wherein a head of the cable is received in the second fixer via the two T-shaped slots and is engaged in the recess of the rotatable disc, an extension is fixed in one of the two holders, and the rotatable disc is received in the second groove, then the first fixer and the second fixer are connected, wherein a spring is fitted on the circular peg of the gear shaft, and the gear shaft is inserted into the fixing orifice of the rotatable disc and the hollow shoulder of the second fixer, a screw element is screwed into the threaded orifice of the circular peg from the bottom of the second fixer, a gear of the gear shaft is engaged in the toothed notch, and the spring abuts against the hollow shoulder and the second column, then an adjustable knob is pressed to drive the gear shaft to move with respect to the base, and the spring is forced by the second column and the hollow shoulder, the gear moves downward to the circular notch to remove from the toothed notch, the adjustable knob is rotated to actuate the gear shaft and the rotatable disc to revolve on the base, and the cable extending out of the recess is winded around the cylinder when the rotatable disc rotates; after releasing the adjustable knob, the spring forces the gear to upwardly move back to an original position and to engage in the toothed notch.

2. The cable adjuster as claimed in claim 1, wherein the first fixer further has at least one limitation protrusion extending from an inner wall of the first groove hereof, and a defining plate includes at least one sector-shaped locating tab extending from a peripheral side thereof and configured to fit with a top of the rotatable disc, the second column of the gear shaft is inserted through a receiving orifice of the defining plate and the fixing orifice of the rotatable disc to be accommodated in the accommodation chamber of the base, when the defining plate rotates to a rotating angle, the at least one sector-shaped locating tab contacts with the at least one limitation protrusion, the rotating angle of the rotatable disc is limited.

* * * * *